US005605099A

United States Patent [19]

Sroka et al.

[11] Patent Number: 5,605,099

[45] Date of Patent: Feb. 25, 1997

[54] MAINTENANCE VEHICLE AND METHOD FOR MEASURING AND MAINTAINING THE LEVEL OF A RAILROAD TRACK

[75] Inventors: Dennis A. Sroka; William E. Perry; Bruce W. Bradshaw, all of Ludington, Mich.; David M. Johnson, Matlock, United Kingdom

[73] Assignee: Pandrol Jackson, Inc., Ludington, Mich.

[21] Appl. No.: 361,571

[22] Filed: Dec. 22, 1994

[51] Int. Cl.[6] ..... E01B 35/00

[52] U.S. Cl. ..... 104/2; 104/7.2; 33/523.1

[58] Field of Search ..... 104/2, 7.2, 8; 33/1 N, 33/1 Q, 523, 523.1, 523.2, 772, 773; 73/146

[56] References Cited

U.S. PATENT DOCUMENTS

| | | | |
|---|---|---|---|
| 3,594,912 | 7/1971 | Sauterel | 33/523 |
| 3,821,853 | 7/1974 | Plasser et al. | 33/523.1 |
| 4,155,176 | 5/1979 | Goel | 33/523.1 |
| 4,173,073 | 11/1979 | Fukazawa et al. | 104/7.2 |
| 4,442,709 | 4/1984 | Waters | 73/146 |
| 4,497,255 | 2/1985 | Theurer | 104/7.2 |
| 4,574,704 | 3/1986 | Cicin-Sain | 104/8 |
| 4,673,854 | 6/1987 | Patton et al. | 104/7.2 |

FOREIGN PATENT DOCUMENTS

| | | |
|---|---|---|
| 2085825 | 5/1982 | United Kingdom . |

*Primary Examiner*—S. Joseph Morano
*Attorney, Agent, or Firm*—Warner Norcross & Judd

[57] ABSTRACT

A maintenance vehicle and associated method for measuring and correcting the level of a railroad track in a single pass. An instrument carriage, or frog, is towed by and in fixed relationship to the maintenance vehicle. The frog carries at least one inclinometer to measure at least one of longitudinal level and crossfall. As the vehicle periodically stops to work the track e.g. tamping or stoneblowing), the inclinometers are provided with the settling time necessary for accurate readings. In an additionally disclosed method, the track is measured and modeled prior to working using a primary measurement system and is then measured and modeled a second time while the track is worked using the frog.

15 Claims, 5 Drawing Sheets

MAINTENANCE VEHICLE AND METHOD FOR MEASURING AND MAINTAINING THE LEVEL OF A RAILROAD TRACK

BACKGROUND OF THE INVENTION

The present invention relates to a railroad track maintenance vehicle and associated method for measuring and maintaining the level of a railroad track.

Trains and other rail vehicles exert tremendous forces on a track when passing thereover. These forces cause movement of the track within the flexible stone bed. Settling and degradation of the ballast stones in the track bed result in deterioration of track level and alignment, which can increase the likelihood of train derailment. Accordingly, periodic reconditioning of the track bed is necessary to maintain the track in a safe condition.

One conventional technique for reconditioning the railroad track bed is known as tamping. Tamping involves lifting the railroad rail and ties and redistributing the existing ballast stones under the lifted tiles to place the rail back into level. A second known technique for reconditioning a railroad track bed is referred to as stoneblowing. Stoneblowing involves lifting the railroad rail and ties and blowing new ballast stones under the lifted ties. In either technique, it is necessary to measure the track level prior to "working" the track to determine where lifting is needed.

Several devices for measuring track level have been developed. A first device includes a pair of chords, one stretched over each of the track rails. A number of transducers are positioned at locations along each chord to measure the distance between the taut chord and the rail. Each transducer measures the deviation of the rail from the straight line defined by the end points of the chord at each measuring position. Measurements are taken at sufficient positions to allow the generation of both loaded and unloaded profiles. Each transducer includes a trolley having a measuring arm that extends upward and is affixed to the chord. As the track rails: rise and fall, the measuring arm, which follows the chord, moves in relation to the trolley to generate an analog signal corresponding to the rise and fall of the rails. The signals are stored and used to reconstruct a mathematical model of the measured track, which can be used in working the track. It should also be noted that the physical chords can be replaced by light beams and optical followers.

A further system is used to measure the crossfall of the rails. Crossfall refers to the transverse level between the two rails. One particular method of measuring crossfall accurately at speed combines measurements of crossfall from different sources, each having particular advantages and disadvantages. The short wavelength crossfall for any location along the rails may be accurately measured by comparing the profile of the first rail at that location with the measured profile of the second rail at that same location. The long wavelength crossfall measurement may be accurately obtained by filtering the output of an inclinometer that is towed along the rails by the track maintenance vehicle. The acquired data is processed to provide a complete profile of the track. The chord type system is subject to error under a variety of circumstances, such as; incorrect trolley deployment, varying chord tension, transducer friction or failure, and profile reconstruction software error. In addition, the systems described suffer from mathematical shortcomings such as "blind spots" where harmonic wavelengths of the transducer/chord distances cannot be measured.

A second method for measuring both longitudinal level and crossfall uses a device commonly referred to as a "frog." A frog includes two gravity sensing inclinometers mounted on a trolley or handcart that is pushed by hand or towed by a vehicle along the rails. The first inclinometer is mounted in alignment with the length of the track and measures the rise and fall of the rails. The second inclinometer is mounted transverse to the length of the track and measures the crossfall of the rails. The inclinometers are affected by acceleration forces and therefore require a small "rest period," or setting time, prior to each measurement. Accordingly, the frog must travel intermittently along the rails, requiring stationary positioning at each measured location, to provide the necessary rest period. It is this intermittent motion that earns this device its name, "frog."

An interconnected towing vehicle and frog are disclosed in United Kingdom Patent No. 2,085,825 published May 6, 1982, and owned by the British Railways Board. The frog is connected to and driven by the towing vehicle in a "lost motion" linkage. The lost motion technique provides; intermittent movement of the frog while the towing vehicle moves continually, thereby establishing a rest period during which the gravity sensing inclinometers settle prior to each measurement. To work the track, the towing vehicle and frog traverse the track in a first pass; the data is analyzed; and then the maintenance vehicle makes a separate pass over the track.

In addition, like the chord type measuring system, frog type measuring systems are subject to a variety of failures that may lead to inaccurate profile reconstruction.

SUMMARY OF THE INVENTION

The present invention provides a maintenance vehicle and associated methods for measuring the level of the railroad track wherein the level is measured by two independent systems whose outputs may be cross-verified to improve accuracy. The present invention also provides for a method for measuring and maintaining the track in a single pass.

The maintenance vehicle includes tamping, stoneblowing, or other maintenance equipment mounted on a superstructure adapted to travel on a railroad track. A frog is mounted to the maintenance vehicle. As the maintenance vehicle travels along the railroad track, it routinely and periodically stops at each tie or each multiple of ties to perform the maintenance function (e.g. tamping or stoneblowing). The stopping period associated with performance of the maintenance function provides settling time, or a rest period, during which the inclinometers on the frog settle.

In a preferred. embodiment, the machinery and method includes both primary and secondary measuring systems, the latter of which is the frog, that can be cross-checked to ensure the validity of the reconstructed track profile.

In a further preferred embodiment, the method includes the following steps: measuring the surface profile of the track using a primary measuring system, such as a chord-type measuring system; developing a first mathematical track model based on data from the primary measuring system; measuring the surface profile of the track using a secondary frog-type system on the same pass over the rails in which the maintenance vehicle reconditions the railroad bed; developing a second mathematical track model based on data from the secondary measuring system; and comparing the first and second track models.

The present invention provides a simple and highly efficient means for measuring and maintaining the level of a railroad track. In addition, by placing the secondary measuring system at sufficient distance ahead of the maintenance vehicle, the invention enables track measurement and track working to occur in a single pass over the rails, thereby eliminating the cost and, and perhaps more importantly, the time of separate vehicles and separate passes over the rails. In the preferred embodiment, the frog operates as a secondary measuring system to double-check and provide back-up for the primary measuring system.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
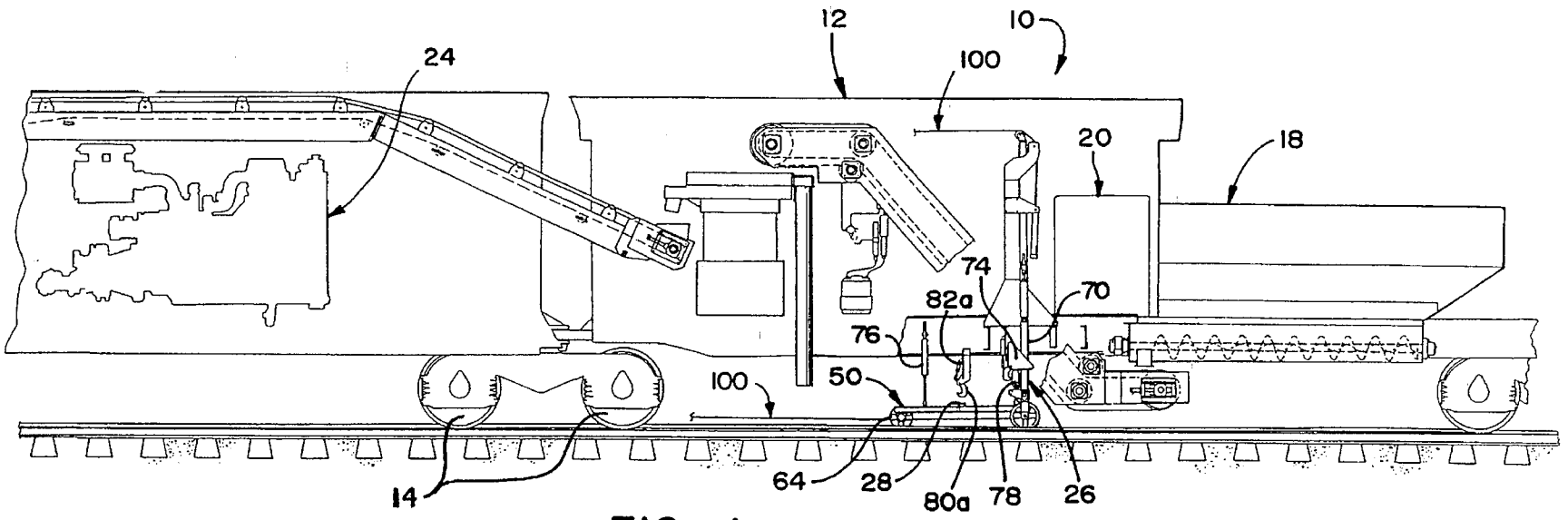
FIG. 1 is a fragmentary side elevational view of a stone blower and frog carried thereby on a section of track.

The maintenance vehicle of the present invention is illustrated in FIG. 1 and generally designated 10. By way of example, and not by way limitation, the present invention is described in connection with a stoneblower. However, as will be readily apparent to those of ordinary skill in the field, the present invention can be used in connection with other track maintenance equipment, such as tampers.

The maintenance vehicle 10 includes a superstructure 12 having wheels 14 for supporting the superstructure 12 upon the rails, a supply of ballast stones 18, a plurality of workheads (not shown), an engine 24 for driving the vehicle 10 along the rails, a conventional chord-type measuring system 100, and a stone metering system for conveying ballast stone from the supply of stones 18 to the workheads. The stoneblower is described in greater detail in U.S. patent application Ser. No. 08/249,742 STONE METERING SYSTEM FOR RAILROAD TRACK MAINTENANCE VEHICLE, filed May 26, 1994, and owned by the assignee of this application, the disclosure of which is incorporated herein by reference.

Figure 2:
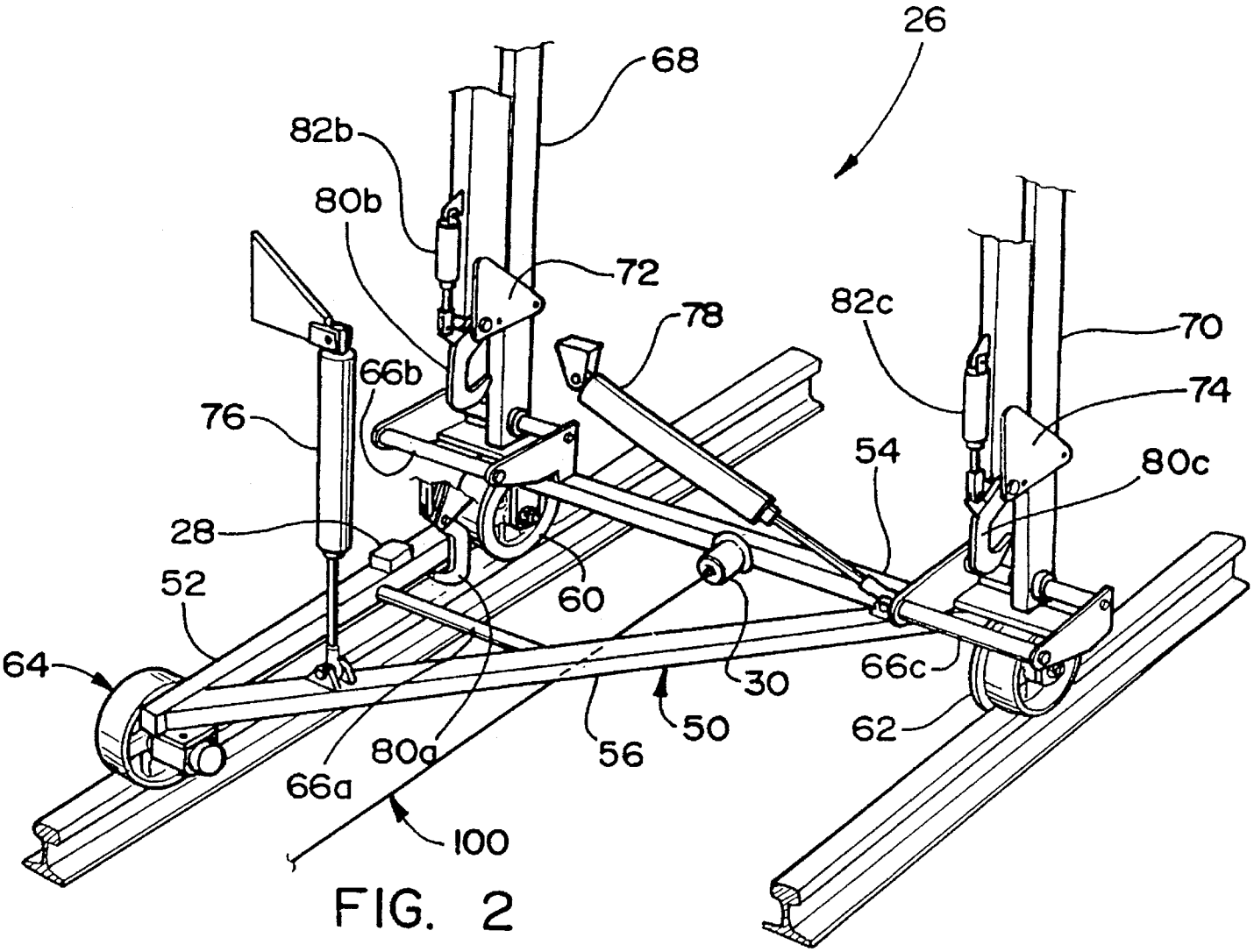
FIG. 2 is a perspective view of the frog on a section of track.

An instrument carriage 26 is secured to the maintenance vehicle 12 and includes a triangular frame 50 that is supported on the rails by wheels 60, 62 and 64. As perhaps best illustrated in FIG. 2, the frame 50 includes a longitudinal beam 52 extending in longitudinal alignment with the track rails, a traverse beam 54 connected to the longitudinal beam 52 and extending transverse to the longitudinal direction of the track rails, and across beam 56 extending between the free ends of the longitudinal and traverse beams 52 and 54. Wheels 60 and 62 are conventional rail wheels that are flanged to ride upon the running surface of the rails. Wheel 64 is a conventional encoder wheel that both supports the instrument carriage 26 and measures the distance travelled along the track.

Figure 3:
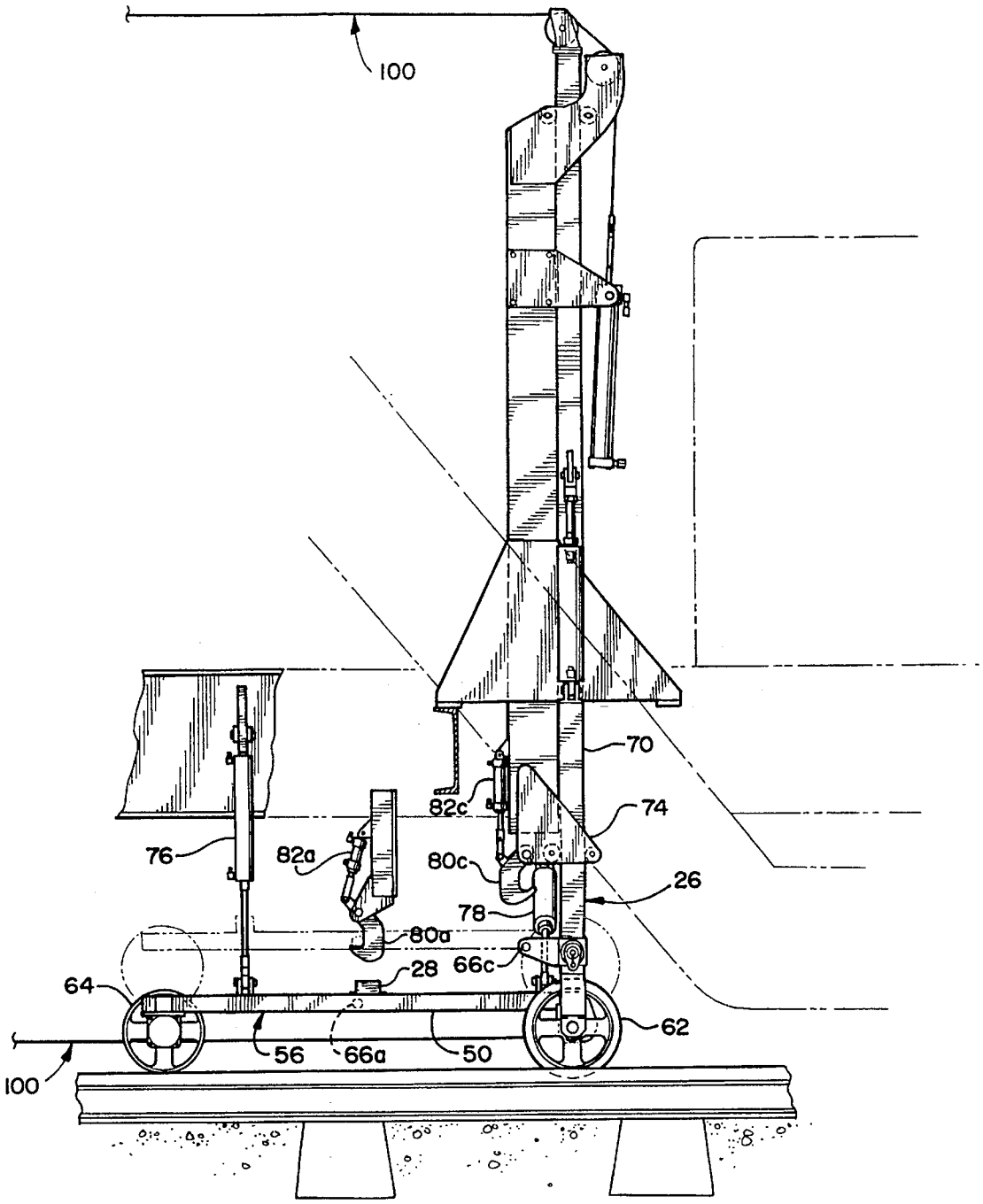
FIG. 3 is a side elevational view of the frog on a section of track.
Figure 4:
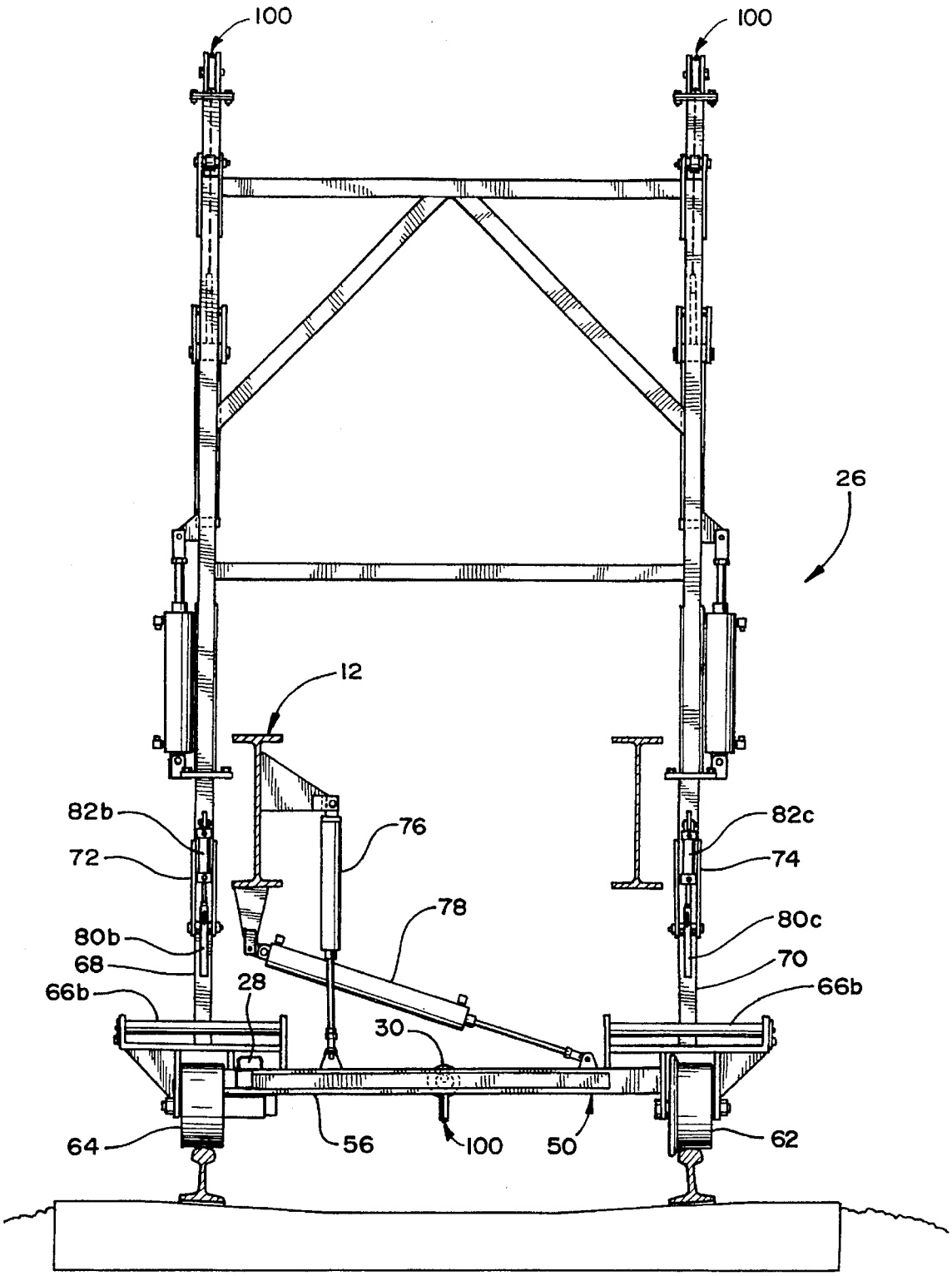
FIG. 4 is a front elevational view of the frog on a section of track.

The instrument Marriage 26 is mounted to the maintenance vehicle 10 so that it is moveable between a lowered position in which the carriage 26 rides upon the track rails and a raised position in which the carriage 26 is lifted from the track rails. Referring to FIGS. 3 and 4, the instrument carriage 26 includes a catch rod 66*a* extending between central portions of the longitudinal beam 52 and, the cross beam 56, a pair of vertical beams 68 and 70 extending upward from opposite ends of the traverse beam 54, and a pair of catch rods 66*b* and 66*c* affixed to each vertical beam 68 and 70. The vertical beams 68 and 70 are slidably received within a pair of guideways 72 and 74 mounted to the superstructure 12. Air cylinders 76 and 78 extend between the superstructure 12 and the instrument carriage 26 to selectively raise and lower the carriage 26, and also to provide downward force to the carriage 26 to ensure that the wheels 60, 62 and 64 ride directly upon the rails. The superstructure 12 further includes three safety hooks 80*a–c* that selectively engage catch rods 66*a–c* to hold the carriage 26 ill the raised position. The safety hooks 80*a–c* are pivotally operated by conventional air cylinders 82*a–c*.

In operation, the carriage 26 may be raised and lowered by extension and retraction of air cylinders 76 and 78. When air cylinders 76 and 78 are retracted, the carriage 26 is lifted into the raised position and air cylinders 82*a–c* may be operated to pivot safety hooks 80*a–c* into engagement with safety rods 66*a–c*, thereby securing the carriage 26 in the raised position. To lower the carriage 26, air cylinders 82*a–c* are operated to pivotally disengage safety hooks 80*a–c* from safety rods 66*a–c*, and air cylinders 76 and 78 are extended to lower the carriage 26. FIG. 3 shows in phantom lines the carriage 26 in the raised position with the safety hooks 80*a–c* and safety rods 66*a–c* engaged.

Figure 5:
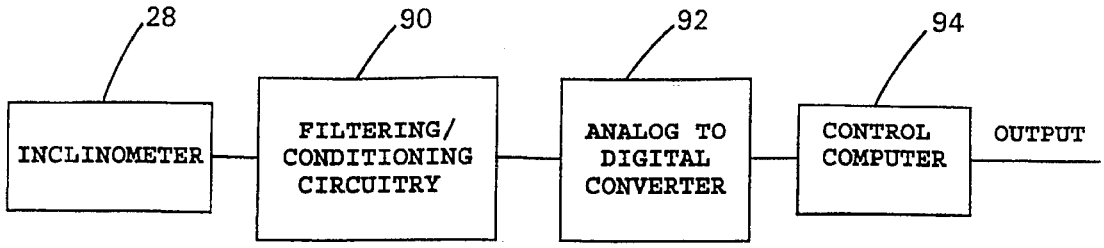
FIG. 5 is a circuit diagram of the filter and signal conditioning circuitry.

A first inclinometer 28 is mounted atop rod 52 at a central location to measure the rise and fall of the first track rail, and a second inclinometer 30 is mounted to the traverse beam 54 at a central location to measure the crossfall of the rails. The crossfall measurement may be used to calculate the rise and fall of the second track rail. The presently preferred inclinometer is a Schaevitz model LSOC +/–14.5 inclinometer having a range of +/–14.5 degrees and providing an output of approximately 0.13 volts/degree about a nominal zero. The inclinometers 28 and 30 require a stable +/–15 volt DC power supply. The power supply of the maintenance vehicle 12 provides power for the inclinometers 28 and 30. A variety of well known DC-DC converters are available to convert the power supply voltage (e.g. 24 volts) of the maintenance vehicle to the voltage required by the inclinometers. To protect against false readings resulting from movement and vibration, the output of each inclinometer 28 and 30 is passed through conventional filtering and conditioning circuitry 90 (see FIG. 5).1 The construction and operation of this circuitry will be readily apparent to one of ordinary skill in the art.

The filtered and conditioned signal passes through an analog-to-digital (A/D) converter 92 to convert the signals to a format readable by a control computer 94. In the preferred embodiment, a 12-bit A/D converter having an input range of +/–5 volts is used. This type of A/D converter is well known to one of ordinary skill in the art. The A/D converter communicates with the control computer via a standard RS232 port.

Figure 6:
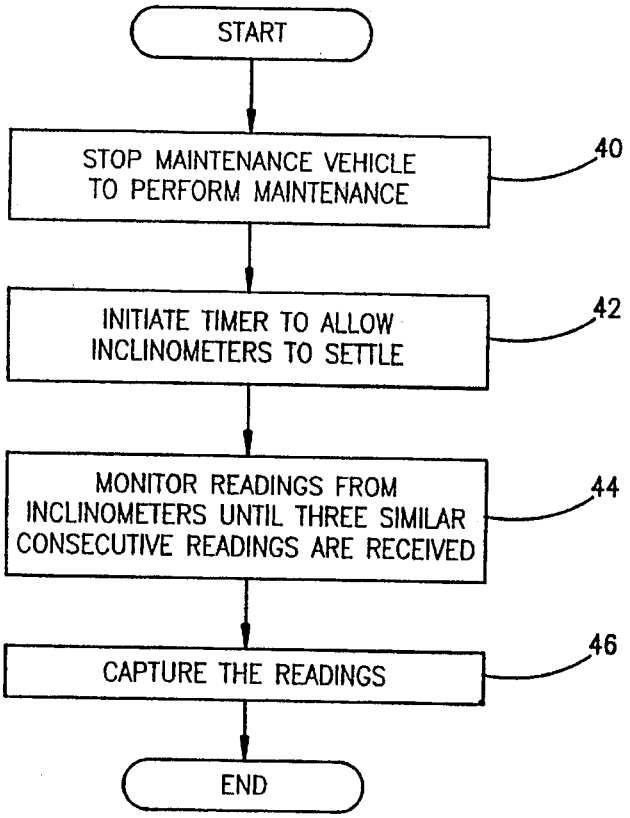
FIG. 6 is a block diagram of the data capture algorithm.

The track data measured by the inclinometers 28 and 30 is captured by the control computer through the data capture algorithm illustrated in FIG. 6. A timer is initiated 42 once the maintenance vehicle stops 40 to perform maintenance along the tracks. The timer allows sufficient time (approximately 3 seconds) for the inclinometer to settle before any readings are taken. At the expiration of the timer, the computer begins to monitor 44 readings from the inclinometer. Once three similar consecutive readings are received, the computer assumes that the inclinometers have reached a steady-state and the readings are captured 46 by the control computer. Reading are considered "similar" when they meet certain criteria, such as within five percent of each other.

The frog may be located toward the forward end of the maintenance vehicle ahead of the workheads to measure the track profile before maintenance is performed. Alternatively, the frog may be located toward the rear of the vehicle behind the workheads to measure the track profile after the maintenance is performed. In another alternative, the frog may be pushed ahead of or pulled behind the maintenance vehicle on a separate trolley.

OPERATION

In operation, the track profile is first measured and modeled primary reference system 100 either carried by or distinct from the maintenance vehicle. This step is generally performed by a chord-type measuring system during an independent pass over the rails. Preferably, the primary measuring system 100 is carried upon the track maintenance vehicle so that the track profile can be measured in a first pass over the rails and then worked on the return pass.

The control computer constructs a second model of the track based on the readings received from the frog 26 during the maintenance pass over the track. A preferred algorithm for reconstructing the profile of the track uses the rise and fall output of the inclinometers to calculate track height progressively. At the beginning of the maintenance and measuring run, an initial assumption of the height of the track is necessary. The accuracy of this initial assumption is not important and simply acts as a nominal zero for the reconstruction.

For purposes of illustration, point A represents the last location along the track where a measurement was taken, and initially represents the starting location for the model construction. Also, the current measured location is referred as point A'. In this embodiment, the third of the three consecutive inclinometer readings is used to represent the rise and fall of the track at the measured location. This value is referred to as theta. The height (ht) of the track at point A' is calculated from the following formula:

$$ht\ (A')=ht\ (A)+(d1+d2)\ *\ \sin\ (\text{theta})$$

where (d1+d2) is the distance moved from the last point of measurement (or point A). The value of (d1+d2) is available directly from distance encoder wheel 64 which rides along the rail to measure the distance travelled by the vehicle. The process is repeated for each measured location to construct a second track model over the travelled length of track.

In order to cross-check the two track profiles, the track model generated from data provided by the secondary measuring system is compared to the track model generated by the primary measuring system 100. If the second track profile deviates substantially from the first, then an inconsistency has been detected; and the discrepancy may be resolved. The discrepancy may be resolved before maintenance continues. For example, it may be necessary to trouble shoot the primary and secondary measuring systems to determine if either has failed. Alternatively, remedial steps may be taken to resolve the discrepancy after the maintenance has been performed. Remedial steps may include such things as reworking the track or trouble shooting the two measuring systems.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A method for measuring and maintaining the level of the rails of a railroad track, comprising the steps of:

(a) measuring data indicative of the profile of the railroad track using a primary measuring system;

(b) measuring data indicative of the profile of the railroad track using a secondary measuring system during a maintenance pass over the rails;

(c) comparing the data collected by the secondary measuring system with the data collected by the primary measuring system to evaluate the accuracy of the data collected by the primary measuring system; and (d) resolving any significant deviation between the data collected by the primary measuring system and the data collected by the secondary measuring system.

2. A method for measuring and maintaining the level of the rails of a railroad track, comprising the steps of:

(a) measuring data indicative of the rise and fall and crossfall of the rails at periodic locations along the length of the railroad track using a first measuring system;

(b) generating a first track profile from the measurements taken by the first measuring system;

(c) measuring data indicative of the rise and fall and crossfall of the rails at periodic locations along the length of the railroad track using a second measuring system during a maintenance pass over the rails;

(d) comparing the data from the second measuring system with the first track profile; and (e) resolving any substantial deviation between the first track profile and the data from the second measuring system.

3. The method of claim 2, wherein the second measuring system is a frog type measuring system.

4. The method of claim 3, wherein the first measuring system is a chord type measuring system.

5. The method of claim 4, further comprising the step of generating a second track profile prior to the comparing step.

6. The method of claim 5, wherein step (c) further comprises the steps of:

(a) measuring data indicative of the rise and fall of one of the railroad track rails and the crossfall of the rails at each location where the maintenance vehicle stops to perform maintenance;

(b) for each location where a measurement is taken, waiting a sufficient period of time for the inclinometers to settle prior to taking any measurements; and (c) measuring the distance travelled along the railroad track rails between each location where a measurement is taken.

7. A method for maintaining railroad track having a plurality of ties comprising:

measuring at least one of longitudinal level and crossfall of a track using a primary measuring system;

moving a vehicle along the track to be leveled;

stopping the vehicle as a function of the locations of the ties;

linking an instrument cart with the vehicle, whereby the cart moves and stops with the vehicle;

positioning at least one inclinometer on the cart to read at least one of longitudinal level and crossfall;

working the track while the vehicle is stopped;

reading the inclinometer while the vehicle and, consequently, the cart are stopped;

comparing at least one of longitudinal level and crossfall measured by the primary measuring system with at least one of longitudinal level and crossfall measured by the inclinometer; and resolving any significant deviation between at least one of longitudinal level and crossfall measured by the primary measuring system and at least one of longitudinal level and crossfall measured by the inclinometer.

8. A method as defined in claim 7 further comprising placing a load on the cart at least during said reading step.

9. A method for measuring and maintaining the level of the rails of a railroad track, comprising the steps of:

(a) measuring data indicative of the profile of the railroad track using a secondary measuring system during a maintenance pass over the rails;

(b) generating a secondary track profile from the data collected by the secondary measuring system;

(c) maintaining the track as a function of the secondary track profile;

(d) measuring data indicative of the profile of the railroad track using a primary measuring system; and (e) generating a primary track profile from the data collected by the primary measuring system;

wherein step (c) includes comparing the primary and secondary track profiles to ensure the validity of the primary track profile, and resolving any significant deviation between the primary and secondary track profiles.

10. The method of claim 9, wherein the primary measuring system and the secondary measuring system are different measuring systems.

11. The method of claim 10, wherein step (d) is further defined as measuring the rise and fall of each of the railroad track rails.

12. The method of claim 11 wherein step (a) is further defined as measuring the rise and fall of one of the railroad track rails and measuring the crossfall of the two railroad track rails.

13. The method of claim 12, wherein the secondary measuring system is a frog type measuring system.

14. The method of claim 13, wherein the primary measuring system is a chord type measuring system.

15. The method of claim 14, wherein step (c) further comprises the steps of:

(a) measuring the profile of the railroad track rails at each location where the maintenance vehicle stops to perform maintenance;

(b) for each location where a measurement is taken, waiting a sufficient period of time for the inclinometers to settle prior to taking any measurements; and (c) measuring the distance travelled along the railroad track rails between each location where a measurement is taken.

* * * * *

UNITED STATES PATENT AND TRADEMARK OFFICE

CERTIFICATE OF CORRECTION

PATENT NO. : 5,605,099

DATED : February 25, 1997

INVENTOR(S) : Dennis A. Sroka et al

It is certified that error appears in the above-indentified patent and that said Letters Patent is hereby corrected as shown below:

Column 8, Claim 15, Line 20:
"(c)" should be --(a)--

In the Abstract, Line 7:
before "e.g." insert --(--

Signed and Sealed this

Eighth Day of July, 1997

Bruce Lehman

*Attest:*

BRUCE LEHMAN

*Attesting Officer*

*Commissioner of Patents and Trademarks*